US011454360B2

(12) United States Patent
Monestier et al.

(10) Patent No.: US 11,454,360 B2
(45) Date of Patent: Sep. 27, 2022

(54) SUPPORT STRUCTURE FOR LIGHTING DEVICE AND LIGHTING SYSTEM

(71) Applicant: Lumileds LLC, San Jose, CA (US)

(72) Inventors: Florent Monestier, Kerkrade (NL); Christian Kleijnen, Ell (NL)

(73) Assignee: LUMILEDS LLC., San Jose, CA (US)

( * ) Notice: Subject to any disclaimer, the term of this patent is extended or adjusted under 35 U.S.C. 154(b) by 0 days.

(21) Appl. No.: 17/338,612

(22) Filed: Jun. 3, 2021

(65) Prior Publication Data

US 2021/0381663 A1 Dec. 9, 2021

Related U.S. Application Data

(60) Provisional application No. 63/034,202, filed on Jun. 3, 2020.

(30) Foreign Application Priority Data

Jul. 30, 2020 (EP) ..... 20188645

(51) Int. Cl.

| | |
|---|---|
| ***F21S 4/24*** | (2016.01) |
| ***F21V 7/00*** | (2006.01) |
| *F21Y 101/00* | (2016.01) |
| *F21Y 103/10* | (2016.01) |
| *F21Y 115/10* | (2016.01) |

(52) U.S. Cl.

CPC ..... *F21S 4/24* (2016.01); *F21V 7/005* (2013.01); *F21Y 2101/00* (2013.01); *F21Y 2103/10* (2016.08); *F21Y 2115/10* (2016.08)

(58) Field of Classification Search

CPC ..... F21S 4/24; F21V 7/005; F21Y 2101/00; F21Y 2103/10; F21Y 2115/10

See application file for complete search history.

(56) References Cited

U.S. PATENT DOCUMENTS

| | | | | |
|---|---|---|---|---|
| 4,654,765 | A | 3/1987 | Laidman | |
| 5,337,225 | A * | 8/1994 | Brookman | F21S 8/032 362/145 |
| 9,644,836 | B1 * | 5/2017 | Field | F21S 4/28 |
| 10,132,478 | B2 * | 11/2018 | Vasylyev | G02B 6/0083 |

(Continued)

OTHER PUBLICATIONS

Extended European Search Report dated Jan. 13, 2021 for European Patent Application No. 20188645.4.

*Primary Examiner* — Evan P Dzierzynski

(74) *Attorney, Agent, or Firm* — Volpe Koenig

(57) ABSTRACT

Support structures and lighting systems including the support structure and a lighting device are described. A support structure includes an inner housing portion, an outer housing portion and connection members. The inner housing portion is transparent and has at least one portion shaped to conform to the lighting device. The outer housing portion includes at least a bottom wall, a first side wall and a second side wall, each having reflective inner surfaces, to form a container. The connection members are transparent and mechanically connected between the inner housing portion and the outer housing portion to support the inner housing portion and divide a region of the container between the inner housing portion and the outer housing portion into first cavities, each enclosed by at least one of the bottom wall, the first side wall or the second side wall and at least one of the connection members.

18 Claims, 4 Drawing Sheets

(56) References Cited

U.S. PATENT DOCUMENTS

| | | | | |
|---|---|---|---|---|
| 10,364,949 | B1 | 7/2019 | Tang | |
| 2004/0179358 | A1 | 9/2004 | Tufte | |
| 2010/0157608 | A1* | 6/2010 | Chen | F21K 9/68 362/296.01 |
| 2016/0201862 | A1* | 7/2016 | Turnbull | F21V 23/008 362/217.05 |
| 2016/0334066 | A1* | 11/2016 | Yuan | F21V 23/003 |
| 2017/0205065 | A1* | 7/2017 | Zanotto | F21V 17/164 |
| 2018/0149320 | A1* | 5/2018 | Mitsuzuka | F21V 3/02 |

* cited by examiner

SUPPORT STRUCTURE FOR LIGHTING DEVICE AND LIGHTING SYSTEM

CROSS REFERENCE TO RELATED APPLICATIONS

This application claims the benefit of U.S. Provisional Patent Application No. 63/034,202, which was filed on Jun. 3, 2020, and European Patent Appln. No. 20188645.4, which was filed on Jul. 30, 2020, the contents of which are hereby incorporated by reference herein.

BACKGROUND

Light emitting elements such as light emitting diodes (LED) are typically arranged on a substrate, such as on a printed circuit board, for supporting and electrically connecting the light emitting elements. Such substrates are typically rigid and may, thus, restrict the shape of a lighting device and hamper a provision of flexible lighting devices.

SUMMARY

Support structures and lighting systems including the support structure and a lighting device are described. A support structure includes an inner housing portion, an outer housing portion and connection members. The inner housing portion is transparent and has at least one portion shaped to conform to the lighting device. The outer housing portion includes at least a bottom wall, a first side wall and a second side wall, each having reflective inner surfaces, to form a container. The connection members are transparent and mechanically connected between the inner housing portion and the outer housing portion to support the inner housing portion and divide a region of the container between the inner housing portion and the outer housing portion into first cavities, each enclosed by at least one of the bottom wall, the first side wall or the second side wall and at least one of the connection members.

BRIEF DESCRIPTION OF THE DRAWINGS

A more detailed understanding can be had from the following description, given by way of example in conjunction with the accompanying drawings wherein.

DETAILED DESCRIPTION

Figure 1A:
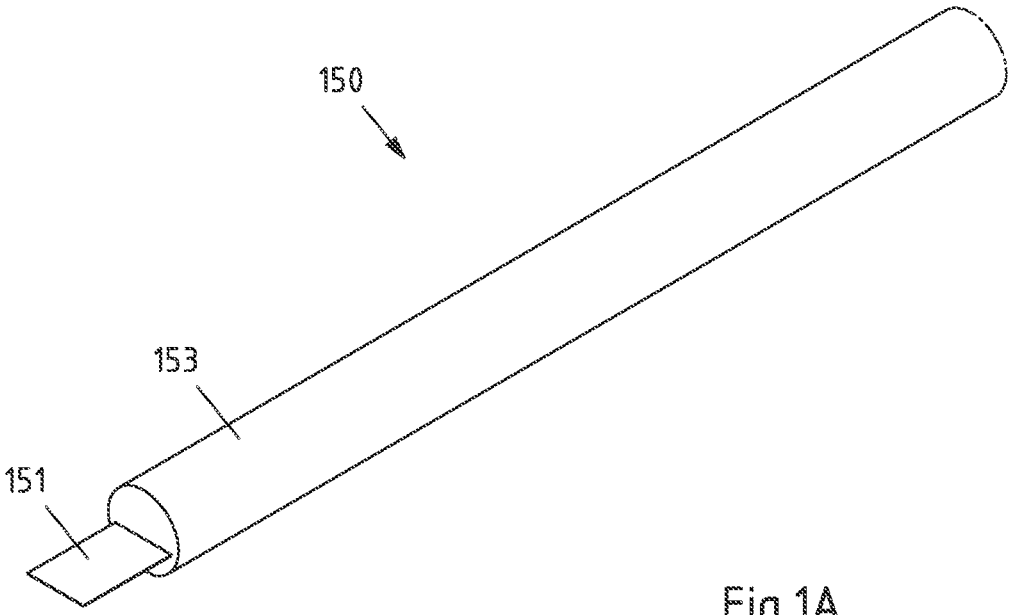
FIG. 1A is a perspective view of a lighting device 150 according to an example embodiment.

Examples of different light illumination systems and/or light emitting diode ("LED") implementations will be described more fully hereinafter with reference to the accompanying drawings. These examples are not mutually exclusive, and features found in one example may be combined with features found in one or more other examples to achieve additional implementations. Accordingly, it will be understood that the examples shown in the accompanying drawings are provided for illustrative purposes only and they are not intended to limit the disclosure in any way. Like numbers refer to like elements throughout.

It will be understood that, although the terms first, second, third, etc. may be used herein to describe various elements, these elements should not be limited by these terms. These terms may be used to distinguish one element from another. For example, a first element may be termed a second element and a second element may be termed a first element without departing from the scope of the present invention. As used herein, the term "and/or" may include any and all combinations of one or more of the associated listed items.

It will be understood that when an element such as a layer, region, or substrate is referred to as being "on" or extending "onto" another element, it may be directly on or extend directly onto the other element or intervening elements may also be present. In contrast, when an element is referred to as being "directly on" or extending "directly onto" another element, there may be no intervening elements present. It will also be understood that when an element is referred to as being "connected" or "coupled" to another element, it may be directly connected or coupled to the other element and/or connected or coupled to the other element via one or more intervening elements. In contrast, when an element is referred to as being "directly connected" or "directly coupled" to another element, there are no intervening elements present between the element and the other element. It will be understood that these terms are intended to encompass different orientations of the element in addition to any orientation depicted in the figures.

Relative terms such as "below," "above," "upper,", "lower," "horizontal" or "vertical" may be used herein to describe a relationship of one element, layer, or region to another element, layer, or region as illustrated in the figures. It will be understood that these terms are intended to encompass different orientations of the device in addition to the orientation depicted in the figures.

Flexibility of lighting devices may be desirable for adjusting shapes of lighting devices to geometries of environments where lighting device are to be installed. For example, in automotive applications it may be desirable to provide flexible lighting devices that follow surfaces or outlines of a car body or of elements within a car interior. Similarly, flexible lightning devices may be of advantage if used for interior decoration.

For example, for automotive lighting applications, flexibility may add an additional degree of freedom for suitably designing appearances of lighting devices. In this way, for example, lighting devices for automotive lighting applications including turn lights, position lights, stop lights or daytime running lights may be improved.

While flexible LED strips may already exist, such LED strips often rely on use of dedicated light emitting diodes (LEDs), which are often larger high-power LEDs and which are often complex and expensive to use in implementations. In order to allow for use of smaller, less complex solutions, in particular, a suitable mechanical interface may be needed to enable mechanical coupling of such further developed flexible lighting devices.

FIG. 1A is a perspective view of a lighting device 150 according to an example embodiment. In the example illustrated in FIG. 1A, the lighting device 150 includes a flexible substrate 151 embedded in a flexible transparent body 153. Both the flexible substrate 151 and the flexible transparent body 153 may extend along a length direction 600 of the lighting device 150. In embodiments, for example, the flexible substrate 151 may be formed from a polyamide material. Such a flexible substrate may be referred to as a flexfoil. The flexible transparent body 153 may be formed from a flexible transparent silicone material. As both the flexible substrate 151 and the transparent body 153 are made of flexible material, the lighting device 150 may advantageously be bendable essentially in all or in all directions.

Figure 1B:
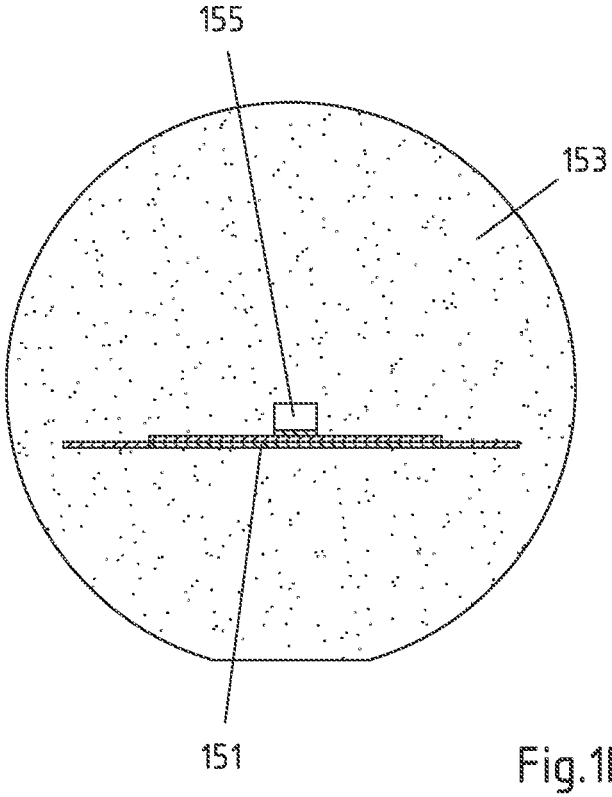
FIG. 1B is a cross-sectional view of the light device 150 of FIG. 1A.

FIG. 1B is a cross-sectional view of the light device 150 of FIG. 1A. In the example illustrated in FIG. 1B, light emitting elements 155 are provided the flexible transparent substrate 151. The flexible transparent substrate 151 and the light emitting elements 155 may be partially or fully embedded and partially or fully encapsulated inside of the flexible transparent body 153 to form, for example, a lighting device that corresponds to an elongated flexible filament comprising LEDs. In addition, in this way, an optimal coupling between the transparent material 151 and light emission faces of LEDs 155 may be achieved. In the example illustrated in FIG. 1B, the light emitting elements 155 are flip-chip light emitting diodes (LEDs). Thus, the construction of the lighting device 150 may enable flexibility allowing for bending the lighting device 150 in all directions and, at the same time, the flexible transparent body 153 may mechanically protect and secure both the flexible transparent substrate 151 and the LEDs 155 such that a particularly robust and reliable mechanical construction may be achieved.

The flexible transparent material 151 may include or be coated with a phosphor material. For example, if the light emitting elements 155 are LEDs configured for blue light transmission, the phosphor particles may be chosen for converting the emitted blue light at least in part into light of a yellow color such that a mixture of the light emitted from the light emitting elements may appear white. Use of phosphor may advantageously allow adjusting light emitted from the light emitting elements provided on the flexible substrate in terms of color, thus, for example, enabling white light emission from the lighting device.

Figure 1C:
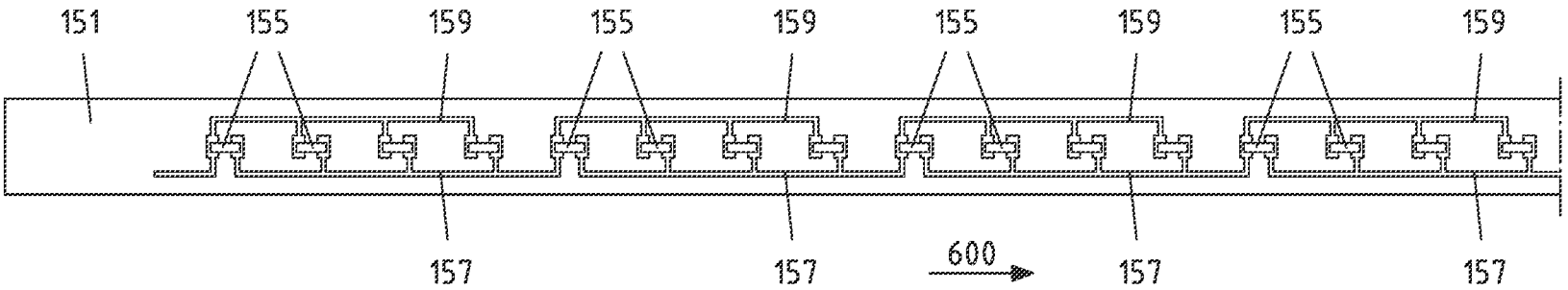
FIG. 1C is a diagram of a number of flip-chip LEDs arranged along the flexible transparent substrate along a length direction thereof.

FIG. 1C is a diagram of a number of flip-chip LEDs 155 arranged along the flexible transparent substrate 151 along a length direction thereof. In embodiments, the lighting device 150 may be inserted into an inner housing portion of a support structure, and the length direction of the transparent substrate 151 may correspond to a length direction of the support structure. As illustrated in the example of FIG. 1C, the flip-chip LEDs 155 are electrically coupled to one another by corresponding conductor tracks 157, 159.

In some embodiments, the LEDs may be small LEDs that may allow for particularly close spacing. In such embodiments, the small LEDs may be, for example, LEDs having a size between 150 μm×500 μm and 70 μm×200 μm. Further, in some embodiments, at least one of the light emitting elements may corresponds to or comprises a flip-chip LED chip. In some embodiments, a distance between neighboring light emitting elements may be around 1 mm. In this way, for example, up to 10 light emitting elements may be arranged per cm. Such high density arrangement may be of advantage as a highly homogeneous intensity/color distribution can be achieved even without using a special spatially adapted diffusor. Such high density arrangement of light emitting elements may allow use of a simple flat diffusor that may be arranged over transparent silicone to achieve a uniform emission area. Thus, the lighting device 150 may advantageously incorporate small, low power, LEDs, corresponding conductor tracks and an optical coupling element, such as the transparent material 153, to form a compact and mechanically reliable flexible light source.

Figure 2:
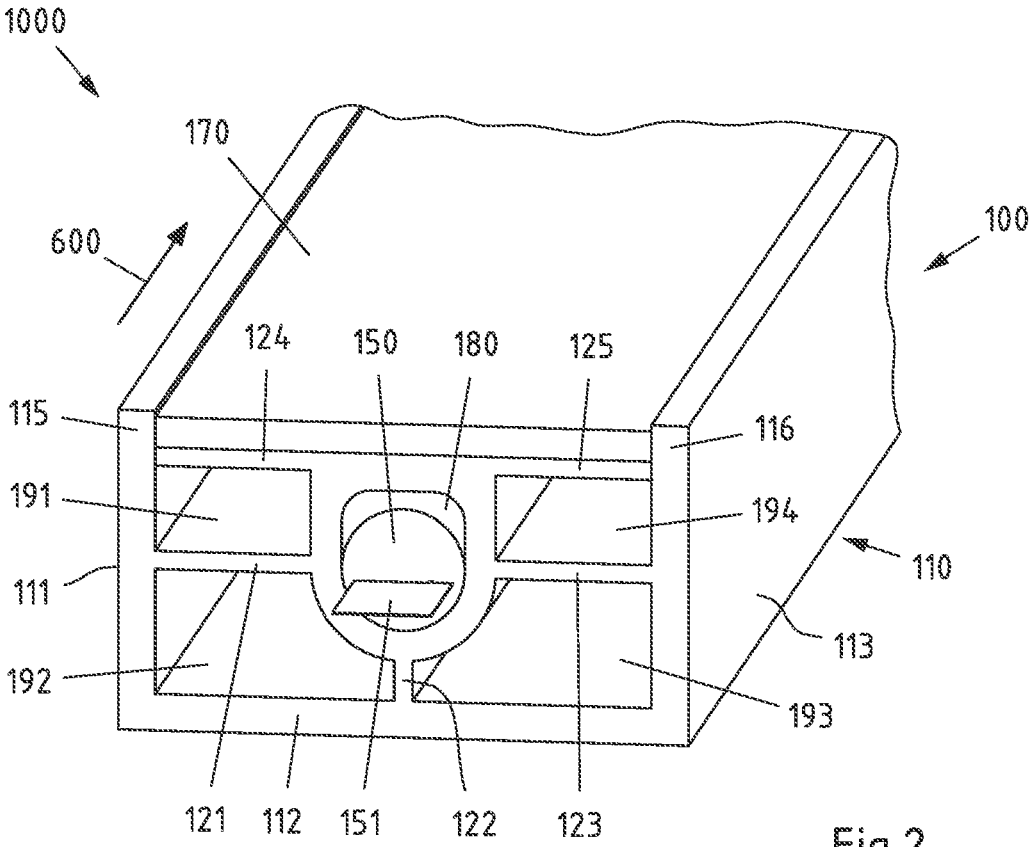
FIG. 2 is perspective view of part of a lighting system including the lighting device of FIGS. 1A, 1B and 1C inserted in an inner housing portion of a support structure.

FIG. 2 is perspective view of part of a lighting system 1000 of FIGS. 1A, 1B and 1C including the lighting device 150 inserted in an inner housing portion 130 of a support structure 100. In the example illustrated in FIG. 2, the inner housing portion 130 is supported by an outer housing portion 110 via wall-shaped connection walls or connection members 121, 122, 123, 124, 125 connected with respective outer walls 111, 111.1, 111.2, 111.3, 111.4, 112, 112.3, 112.4, 113, 113.1, 113.2, 113.3, 113.4, 114.1, 114.4 of the outer housing portion 110.

In the example illustrated in FIG. 2, the support structure 100 further comprises four first cavities 191, 192, 193, 194 arranged in between respective outer walls of the outer housing portion 110 and the inner housing portion 130, whereby at least two cavities are separated by at least one connection member. For example, cavities 191, 192 may be arranged in between outer wall 111 and inner housing portion 130, being mutually separated by the wall-shaped connection wall 121. A further, second cavity 180 may be formed in the inner housing portion 130 between the lighting device 150 and inner walls of the inner housing portion. While the first cavities 191, 192, 193, 194 may be advantageously void of any solid filling material and/or may be filled with air, thereby contributing to advantageous flexibility of lighting system 1000 and advantageously contributing to a decoupling of thermal deformations of the inner housing portion 130 from outer housing portion 110, the at least one second cavity may be filled with a suitable flexible transparent material, such as silicone, if desired (e.g., for more stably fixing lighting device 150 within the inner housing portion 130).

In embodiments, a special arrangement may be provided that not only may allow for securely mounting the lighting device inside of the outer housing portion but may also reduce an amount of material provided within the outer housing portion for this purpose. A further effect of the special arrangement may be that the cavities may allow for a deformation, such as an expansion and corresponding contraction, of the inner housing portion as a result of a thermal deformation of an inserted lighting device upon operation to be advantageously decoupled from the outer housing portion. Thereby, reliability of a lighting system comprising the support structure and a corresponding lighting device during a thermal cycle may be advantageously improved.

In some embodiments, the first cavities may be void, which may, in at least some embodiments, be understood to mean that the first cavities are not filled with a filling material, such as a transparent silicone material. In at least some embodiments, being void may additionally or alternatively be understood to mean that first cavities may include air. In such embodiments, the first cavities may not only advantageously allow for a reduction of material and the described improvement of reliability during the thermal cycle but may also contribute to an advantageous flexibility of the support structure. In addition, by suitably adjusting a shape of the first cavities, which may be accomplished, for example, by suitably adjusting a shape of one or more connection members, an advantageous degree of freedom in design may be provided, which may allow adjusting properties of light emitted by a lighting system comprising the support structure and the lighting device. Further, adjusting a shape of the one or more first cavities may allow for suitably adjusting an intensity of emitted light as a function of a light emission angle.

While FIG. 2 shows an embodiment that has four cavities, embodiments are described herein that include different numbers of cavities. In an exemplary embodiment, at least one first cavity is filled with a transparent and flexible material, such as with a transparent and flexible silicone. In this case, in an exemplary embodiment, the inner housing portion may be essentially half-tube-shaped and the transparent and flexible material may be provided to cover a side of an inserted lighting device not covered by the half-tube-shaped inner housing portion. In this way, an amount of transparent and flexible material otherwise used for fully embedding such lighting device may be advantageously reduced while the use of a half-tube-shaped housing portion may be advantageous as it may enable a simple process of inserting a lighting device into the inner housing portion.

In an exemplary embodiment, the inner housing portion may essentially be tube-shaped or half-tube-shaped and may extend along the length direction (e.g., the entire length direction) of the support structure. In other words, in an exemplary embodiment, a cross-section of the inner housing portion may at least in part correspond to a circular segment. Such shape of the inner housing portion may be beneficial in terms of mechanical stability while, in particular, omission of edges within outer surfaces of the inner housing portion may help to achieve a homogeneous light distribution.

In an exemplary embodiment, the support structure may comprise at least two first cavities arranged in between the at least one outer wall of the outer housing portion and the inner housing portion. The at least two first cavities may be at least in part separated by the at least one connection member. In an exemplary embodiment, the at least one first cavity and/or the at least two first cavities may be arranged in between at least two outer walls of the outer housing portion (e.g., inside of the outer housing portion). In an exemplary embodiment, one, more or all of the at least one first cavity may extend along the entire length direction of the support structure.

In an exemplary embodiment, the inner housing portion, the outer housing portion and the at least one connection member may be flexible. Thus, the support structure may be suitable for receiving a flexible lighting device such as a flexible light emitting diode (LED) strip. The inner housing portion may be at least in part made or fully made of a transparent material and may correspond to a cavity or tube into which the lighting device can be inserted.

In the example illustrated in FIG. 2, an optical diffuser 170 is arranged in between two locking extensions 115, 116, which respectively are integrally formed with outer walls 111, 113 of the outer housing portion. The two locking extensions 115, 116 may advantageously help to support the diffuser 170 at the support structure 100 and may, for example, be used to lock an optical diffusing element 170 to the support structure. In some embodiments, the at least two locking extensions may extend from an outer surface of the outer housing portion and/or may be integrally formed with outer walls of the outer housing portion. Such locking extensions may, for example, be provided along edges of said light output or exit face of the outer housing portion (e.g., along the length direction of the support structure). The locking extensions may in this way be provided for mounting an optical diffusing element, such as an optical diffuser plate made from a transparent flexible material (e.g., transparent flexible silicone) comprising for example titanium oxide ($TiO_2$) particles dispersed therein. The provision of such diffusing element may enable further homogenizing light emitted from a lighting system comprising the support structure and a corresponding lighting element.

Optical diffusor 170 may be made from a suitable transparent material, such as transparent flexible silicone. The suitable transparent material may comprise suitable particles, such as $TiO_2$ particles, which may be embedded therein for diffusing light emitted from lighting device 150.

While outer walls 111, 111.1, 111.2, 111.3, 111.4, 112, 112.3, 112.4, 113, 113.1, 113.2, 113.3, 113.4, 114.1, 114.4 forming the outer housing portion 110 may suitably be made of a material of white appearance, with inner surfaces configured for reflecting light emitted from lighting device 150, such as a flexible silicone material with $TiO_2$ particles embedded therein, the inner housing portion 130 and connection walls 121, 122, 123, 124, 125 may entirely or at least in part be advantageously be made of an optically transparent material, such as a flexible transparent silicone material. In this way, the at least one connection member may advantageously allow for an enhanced intensity of light output by a lighting system comprising the support structure and a corresponding lighting device.

In some embodiments, at least one connection member may be configured to compensate for a thermal deformation of the inner housing portion. In other words, in such embodiments, at least one connection member may be configured to decouple a thermal deformation of the inner housing portion from the outer housing portion. In some embodiments, thermal deformation of the inner housing portion may be understood as a deformation of the inner housing portion as a result of a deformation of a lighting device inserted in the inner housing portion upon operation of the lighting device. To this end, in some embodiments, the at least one connection member may be elastic (e.g., may be able to be deformed and to then return to its original shape). In other words, the at least one connection member may provide for a spring function as a result of which a position of a lighting device inserted into the inner housing portion with respect to the outer housing portion may remain essentially unchanged even though the lighting device and, thus, the inner housing portion may expand (or contract) upon operation of the lighting device.

In some embodiments, at least one connection member may at least in part be essentially wall-shaped. In other words, in some embodiments, at least one connection member may correspond to or comprises a connection wall. Further, in some embodiments, the outer housing portion may comprise (e.g., be formed from) at least one outer wall, and a thickness of the at least one essentially wall-shaped connection member may be smaller than a thickness of the at least one outer wall. In some embodiments, a ratio of the thickness of the at least one essentially wall-shaped connection member to the thickness of the at least one outer wall may be smaller than 8/10, or even, in some embodiments, smaller than 6/10. In other words, at least one connection member may correspond to one or more thin walls by means of which the inner housing portion may be mechanically connected to and, thus, supported by, the outer housing portion. For example, a thickness of the at least one essentially wall-shaped connection member may be approximately 0.5 mm, and a thickness of the at least one outer wall may be approximately 1.0 mm. Such a special arrangement of the thin walls may advantageously allow suitably holding and supporting the lighting device within the outer housing portion while decoupling any thermal deformation of the inner housing portion from the outer housing portion.

In some embodiments, at least one connection member may comprise at least one first wall portion mechanically connected to the outer housing portion and at least one second wall portion mechanically connected to the inner housing portion. Thereby, the first wall portion and the second wall portion may be mutually mechanically connected at an angle. In some embodiments, the angle may be between 60° and 120°, between 70° and 110°, between 80° and 100°, and/or 90°±5°. Such a geometry of at least one connection member may provide an advantageous elasticity or spring function and enable the at least one connection member to move with and thus to compensate for deformations of the inner housing portion caused by thermal expansion and contraction of an inserted lighting device upon operation. The geometry may advantageously reduce wear of the at least one connection member caused by such repeated movement.

In an exemplary embodiment, the inner housing portion may be configured to enable light emitted from an inserted lighting device to be transmitted in all directions. Thereby, light emitted from an inserted lighting device may be transmitted towards inner walls of the inner housing portion. With the at least one inner surface of the outer housing portion being at least partially reflective (e.g., diffuse reflective), light emitted from an inserted lighting device may be reflected either back into the outer housing or towards a light output or exit face of the outer housing to be emitted to the outside. Light reflected back into the outer housing portion may eventually leave the outer housing via said light output face after one or more further reflections by inner walls of the inner housing portion. In this way, the outer housing portion 110 may advantageously serve as mix box for light emitted from lighting device 150 inserted in the inner housing portion. Light emitted via a light output or exit face of the lighting system 1000, which, in the illustrated example, corresponds to diffusing element 170, may thus advantageously be made homogeneous in terms of color and appearance. Outer housing portion 110 with inner reflective (e.g., diffuse reflective) surfaces may thus advantageously help to reduce or even prevent hot spots or regions, such as spots or regions of higher intensity and/or changed color, in a distribution of intensity and/or color of light emitted from the lighting system 1000. The diffusing element 170 may further contribute to this advantageous effect. For example, the provision of outer housing portion 110 may advantageously enable the support structure to be particularly suitable for flexible lighting devices as the mixing box property of the outer housing portion 110 may help to compensate for hot spot/regions, which may be caused, for example, by bending the flexible lighting device.

In an exemplary embodiment, the inner housing portion, the outer housing portion and the at least one connection member may be integrally formed. For example, the inner housing portion, the outer housing portion and the at least one connection member may advantageously be fabricated in a same process, for example, by extruding or by molding. For example, a 2K extrusion process may be advantageously employed for forming the inner housing portion, the outer housing portion and the at least one connection member in a same process. Alternatively, a 2K molding process may be employed. In some embodiments, 2K molding may comprise or correspond to 2K injection molding by means of which it may be possible that two materials and/or colors are molded into one plastic part. Thus, providing the inner housing portion, the outer housing portion and the at least one connection member as an integral component may be advantageous not only as it may allow fabricating a reliable and stable component, but, in addition, in terms of production simplification.

In some embodiments, the outer housing portion, the inner housing portion and the at least one connection member may be formed from transparent silicone, which may enable advantageous flexibility of the support structure. Thereby, in some embodiments, the outer housing portion may comprise at least one outer wall formed from white diffusive reflective silicone. In some embodiments, the outer housing portion may thus comprise at least one outer wall formed from a silicone matrix including metal oxide particles. In some embodiments, the metal oxide particles may correspond to or comprise $TiO_2$ particles. The choice of this material may advantageously allow light emitted from a lighting device inserted in the inner housing portion to be redirected towards a light emission face of the outer housing portion. Further, in some embodiments, the outer housing portion, the inner housing portion and/or the at least one connection member may be formed from or comprise silicone with particles of a diffusive material, such as metal oxide (e.g., $TiO_2$) particles, embedded therein. The choice of this material may advantageously allow light emitted from a lighting device inserted in the inner housing portion to be made homogeneous in intensity and color.

Figure 3:
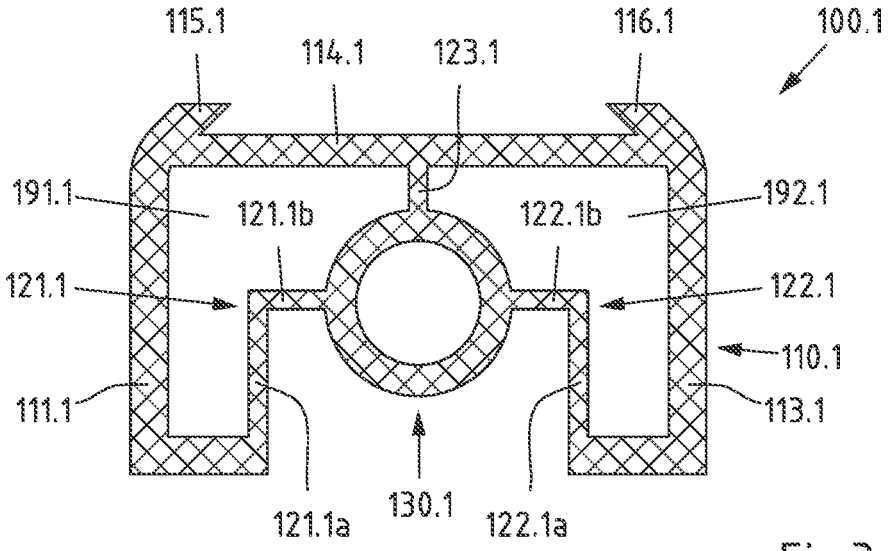
FIG. 3 is a cross-sectional view of a further embodiment of a support structure with an outer housing portion and an inner housing portion.

FIG. 3 is a cross-sectional view of a further embodiment of a support structure 100.1 with an outer housing portion 110.1 and an inner housing portion 130.1. The inner housing portion may be connected with and thus supported by the outer housing portion 110.1 via connection members 121.1, 122.1, 123.3. In the example illustrated in FIG. 3, a connection member 121.1 comprises a first wall portion 121.1*a* mechanically connected with the outer housing portion 110.1 and a second wall portion 121.1 mechanically connected with the inner housing portion 130.1. The first wall portion 121.1*a* and the second wall portion 121.1*b* may be mutually mechanically connected at an angle of essentially 90°. As can be derived from FIG. 3, connection member 122.1 may have a corresponding construction with similar first and second wall portions 122.1*a*, 122.1*b*. The particular construction of connection members 121.1 and 122.1 may enable a beneficial elasticity of these connection members, which may allow connections members 121.1 and 122.1 to move in correspondence with an expansion of inner housing portion 130.1 as a result of a thermal expansion of an inserted lighting device therein and to return to an initial position thereafter. Such construction may reduce wear of these connection members, which may otherwise be caused by such movement.

In the example illustrated in FIG. 3, locking protrusions 114.1 and 115.1 respectively extend from an upper wall 114.1 of the outer housing portion 110.1. In some embodiments, the at least two locking protrusions 115.1 and 116.1 may inwardly bend towards each other thereby forming a corresponding locking space with upper wall 114.1 for inserting and firmly holding a diffusing element (not shown in FIG. 3).

The support structure 100.1 may include two first cavities 191.1, 192.1 arranged in between upper wall 114.1 inner housing portion 130.1. These two first cavities 191.1, 191.2 may be separated by a connection wall 123.3. As in case of the first cavities of FIG. 2, the first cavities 191.1, 191.2 of FIG. 3 may be arranged in between the pair of outer walls 111.1 and 113.1. In other words, the first cavities 191.1, 191.2 may be arranged inside of outer housing portion 100.1, the construction thus only using a minimum of necessary material, the first cavities contributing to advantageous flexibility of a corresponding lighting system and allowing for movement of connection elements 121.1 and 122.1 in reaction to a thermal movement of a lighting device received by inner housing portion 130.1.

Figure 4:
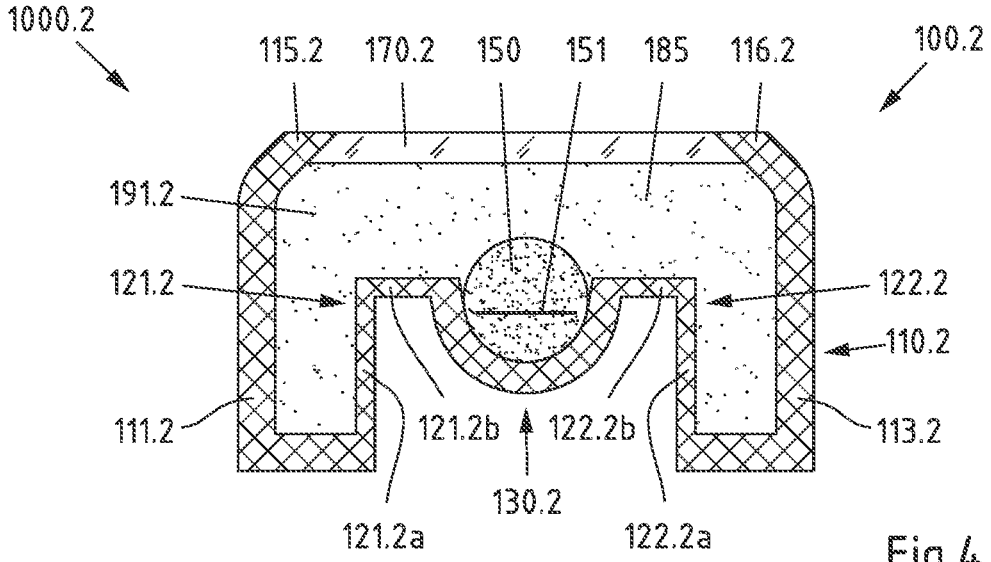
FIG. 4 is a cross-sectional view of a further exemplary embodiment of a lighting system.

FIG. 4 is a cross-sectional view of a further exemplary embodiment of a lighting system 1000.2. In the example illustrated in FIG. 4, the support structure 100.2 comprises one first cavity (e.g., only one first cavity) 191.2 arranged in between outer wall 111.2 and connection member 121.2. Thereby, connection members 121.2 and 122.2 may be further examples of connection members respectively comprising first wall portions 121.2*a*, 122.2*a* mechanically connected to the outer housing portion 110.2 and second wall portions 121.2*b*, 122.2*b* mechanically connected to inner housing portion 130.2, wherein the first wall portions 121.2*a*, 122.2*a* and second wall portions 121.2*b*, 122.2*b* may respectively form connection angles of 90°.

In embodiments, the inner housing portion 130.2 may be essentially half-tube shaped, and a flexible transparent material, such as a flexible transparent silicone 185, may be provided covering an upper side of the inserted lighting device 150 not covered by the half-tube shaped inner housing portion 130.2. Further, in the example illustrated in FIG. 4, locking extensions 115.2, 116.2 extend from outer walls 111.2, 113.2, which are respectively being bent inwardly to form a locking space with an upper face of the inserted transparent flexible material 185 for fixedly holding the diffusing element 170.2. A lighting device 150, such as described above, may be disposed in and supported by the inner housing portion 130.2. In some embodiments, the lighting device 150 may be secured in place within the inner housing portion 130.2 by adding an end cap at respective extremities of the support structure.

Figure 5:
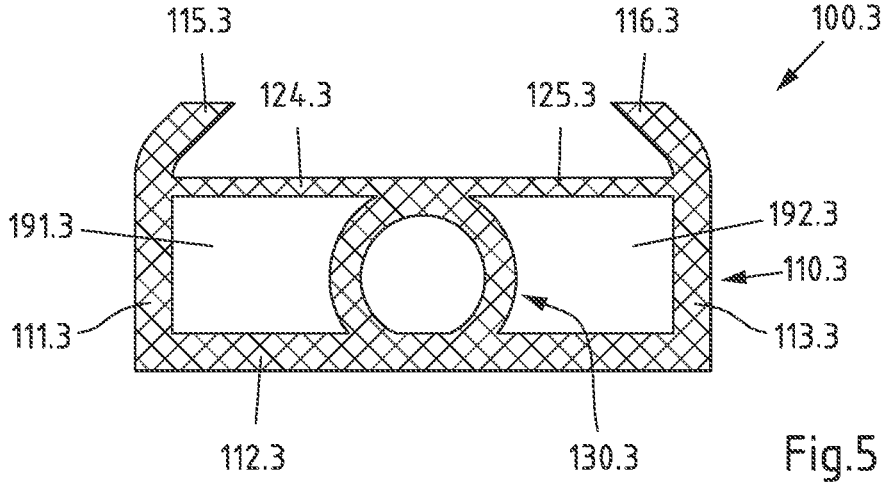
FIG. 5 is a cross-sectional view of a further embodiment of a support structure.

FIG. 5 is a cross-sectional view of a further embodiment of a support structure 100.3, which is similar to support structure 100 shown in FIG. 2 with connection walls 121, 122 and 123 of support structure 100 being omitted. In other words, support structure 110.3 may comprise a pair of connection walls 124.3, 125.3 (e.g., only one pair) mechanically connecting the inner housing portion 130.3 and the outer housing portion 110.3, the outer housing portion being formed by outer walls 111.3, 112.3, 113.3 from which respective locking extensions 115.3 and 116.3 extend being respectively bent inwardly. Two first cavities 191.3 and 192.3 may be arranged in between locking members 124.3, 125.3 and outer wall 112.3, respectively, the two first cavities 191.3 and 192.3 being separated by a connection portion of connection members 124.3 and 125.3.

Figure 6:
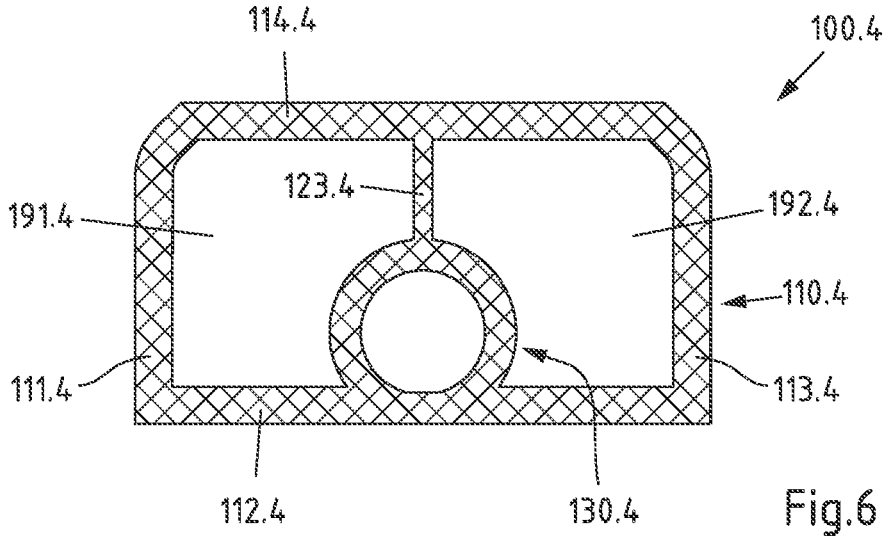
FIG. 6 is a cross-sectional view of a further embodiment of a support structure.

FIG. 6 is a cross-sectional view of a further embodiment of a support structure 100.4, which is similar to support structure 100.1 shown in FIG. 3, whereby connection elements 121.1 and 122.1 are omitted. In other words, support structure 104 includes one connection member 123.4 (which may be only one connection member) mechanically connecting inner housing portion 130.4 and the outer housing portion 110.4. In the example illustrated in FIG. 6, the outer housing portion 110.4 is formed from outer walls 111.4, 112.4, 113.4 and upper wall 114.4. Two first cavities 191.4 and 192.4 may be arranged in between locking member 123.4 and outer walls 111.4, 113.4, respectively, the two first cavities 191.4 and 192.4 being separated by connection member 123.4.

Having described the embodiments in detail, those skilled in the art will appreciate that, given the present description, modifications may be made to the embodiments described herein without departing from the spirit of the inventive concept. Therefore, it is not intended that the scope of the invention be limited to the specific embodiments illustrated and described.

What is claimed is:

1. A support for a lighting device, the support comprising:

an inner housing portion formed from a transparent material and having at least one portion that is shaped to conform to a shape of the lighting device;

an outer housing portion comprising at least a bottom wall, a first side wall and a second side wall to form a container, each of the bottom wall, the first side wall and the second wall having reflective inner surfaces facing the inner housing portion; and a plurality of connection members, formed from the transparent material, and mechanically connected between the inner housing portion and the outer housing portion to support the inner housing portion and divide a region of the container between the inner housing portion and the outer housing portion into a plurality of first cavities, each of the plurality of first cavities being enclosed by at least one of the bottom wall, the first side wall or the second side wall and at least one of the plurality of connection members, and the plurality of first cavities being fully separated from one another via at least one of: at least one of the plurality of connection members or the inner housing portion.

2. The support structure according to claim 1, wherein the at least one connection member is at least in part made of a transparent material.

3. The support structure according to claim 1, wherein the at least one connection member is configured to compensate for a thermal deformation of the inner housing portion.

4. The support structure according to claim 1, wherein the at least one connection member is at least one of elastic or at least partially transparent.

5. The support structure according to claim 1, wherein the at least one connection member is at least in part wall-shaped.

6. The support structure according to claim 5, wherein: the outer housing portion comprises at least one outer wall, and a thickness of the at least one wall-shaped connection member is smaller than a thickness of the at least one outer wall.

7. The support structure according to claim 1, wherein the at least one connection member comprises at least one first wall portion mechanically coupled to the outer housing portion and at least one second wall portion mechanically coupled to the inner housing portion.

8. The support structure according to claim 7, wherein the first wall portion and the second wall portion are mutually mechanically connected at an angle.

9. The support structure according to claim 1, wherein the inner housing portion is one of essentially tube-shaped or half-tube-shaped and extends along a length direction of the support structure.

10. The support structure according to any of claim 1, further comprising at least two locking extensions configured to lock an optical diffusing element to the support structure.

11. The support structure according to claim 1, wherein the inner housing portion, the outer housing portion and the at least one connection member are integrally formed.

12. The support structure according to claim 1, wherein the outer housing portion, the inner housing portion and the at least one connection member are formed from transparent silicone.

13. The support structure according to claim 1, wherein the plurality of first cavities are void of any solid filling material.

14. A lighting system comprising:

a support structure comprising:

an inner housing portion formed from a transparent material and having at least one portion that is shaped to conform to a shape of the lighting device, an outer housing portion comprising at least a bottom wall, a first side wall and a second side wall to form a container, each of the bottom wall, the first side wall and the second wall having reflective inner surfaces facing the inner housing portion, and a plurality of connection members, formed from the transparent material, and mechanically connected between the inner housing portion and the outer housing portion to support the inner housing portion and divide a region of the container between the inner housing portion and the outer housing portion into a plurality of first cavities, each of the plurality of first cavities being enclosed by at least one of the bottom wall, the first side wall or the second side wall and at least one of the plurality of connection members, and the plurality of first cavities being fully separated from one another via at least one of: at least one of the plurality of connection members or the inner housing portion; and a lighting device in the inner housing portion.

15. The lighting system according to claim 14, wherein the lighting device comprises:

a flexible substrate that extends along a length direction of the support structure, and at least two light emitting elements on the flexible substrate along the length direction of the support structure.

16. The lighting system according to claim 15, wherein the flexible substrate and the at least two light emitting elements are embedded in a flexible transparent material.

17. The lighting system according claim 14, further comprising at least one second cavity between the lighting device and an inner wall of the inner housing portion.

18. The lighting system according to claim 14, wherein the plurality of first cavities are void of any solid filling material.

* * * * *